US008474618B2

(12) United States Patent
McDowell

(10) Patent No.: US 8,474,618 B2
(45) Date of Patent: Jul. 2, 2013

(54) SINGLE GLASS SHEET PACKAGE WITH SUCTION CUPS

(75) Inventor: Richard B. McDowell, Ligonier, PA (US)

(73) Assignee: Menasha Corporation, Neenah, WI (US)

( * ) Notice: Subject to any disclaimer, the term of this patent is extended or adjusted under 35 U.S.C. 154(b) by 1040 days.

(21) Appl. No.: 11/799,028

(22) Filed: Apr. 30, 2007

(65) Prior Publication Data

US 2008/0264819 A1 Oct. 30, 2008

(51) Int. Cl.
*B65D 85/48* (2006.01)

(52) U.S. Cl.
USPC ..... 206/448; 206/451

(58) Field of Classification Search
USPC ..... 206/448, 451, 454, 597, 756, 452, 206/449; 220/483; 451/494; 248/206.5, 309.3, 248/362, 363, 467, 537
See application file for complete search history.

(56) References Cited

U.S. PATENT DOCUMENTS

| | | | | |
|---|---|---|---|---|
| 2,171,051 | A | 8/1939 | Stonecypher | |
| 2,305,405 | A * | 12/1942 | Burrell | 206/451 |
| 2,331,753 | A | 10/1943 | Wohlers | |
| 2,665,804 | A | 1/1954 | Koester | |
| 2,673,023 | A | 3/1954 | Vander Lugt, Jr. | |
| 2,734,626 | A | 2/1956 | Koester et al. | |
| 2,743,010 | A | 4/1956 | Koester | |
| 2,806,592 | A | 9/1957 | Hatfield | |
| 2,839,198 | A | 6/1958 | Lefevre | |
| 2,873,024 | A * | 2/1959 | Koester | 206/448 |
| 2,967,009 | A * | 1/1961 | Lidgard | 206/448 |
| 2,981,407 | A | 4/1961 | Gaulke et al. | |
| 3,159,275 | A | 12/1964 | Van Antwerpen et al. | |
| 3,385,462 | A * | 5/1968 | Deldime et al. | 53/447 |
| 3,389,785 | A * | 6/1968 | Lidgard | 206/448 |
| 3,403,778 | A | 10/1968 | Voytko et al. | |
| 3,469,762 | A | 9/1969 | La Torre | |
| 3,476,303 | A | 11/1969 | Smith | |
| 3,493,128 | A | 2/1970 | Silvert | |
| 3,519,244 | A | 7/1970 | Lidgard | |
| 3,616,986 | A | 11/1971 | Wolfe | |
| 3,884,356 | A | 5/1975 | Lidgard | |
| 3,900,976 | A * | 8/1975 | Kitts, Jr. | 451/494 |
| 3,938,660 | A | 2/1976 | Moehring | |
| 3,985,231 | A | 10/1976 | Farhat et al. | |
| 4,014,435 | A | 3/1977 | Rowley et al. | |
| 4,086,263 | A | 4/1978 | Rowley | |
| 4,098,401 | A | 7/1978 | Brown et al. | |
| 4,182,450 | A * | 1/1980 | Kryger | 206/448 |
| 4,225,043 | A | 9/1980 | Lastik | |
| 4,317,536 | A | 3/1982 | Dickerson | |

(Continued)

FOREIGN PATENT DOCUMENTS

| | | |
|---|---|---|
| CA | 1097283 | 3/1981 |
| GB | 1332546 | 10/1973 |

*Primary Examiner* — Jacob K Ackun
*Assistant Examiner* — Jenine Pagan
(74) *Attorney, Agent, or Firm* — Ungaretti & Harris LLP

(57) ABSTRACT

A corrugated container for shipping a glass sheet, such as an automotive windshield, is disclosed. The container includes one or more support braces for contacting a first side of the glass sheet and one or more braces for contacting the opposing second side of the glass sheet. Suction cups can be connected to the braces. A cross-brace, generally perpendicular to the other support braces, can be provided for added protection and support of the glass sheet.

20 Claims, 6 Drawing Sheets

U.S. PATENT DOCUMENTS

| | | | | | |
|---|---|---|---|---|---|
| 4,467,922 | A | | 8/1984 | Rowley | |
| 4,477,015 | A | | 10/1984 | Lozaun | |
| 4,489,835 | A | | 12/1984 | Tombal et al. | |
| 4,697,731 | A | | 10/1987 | Snyder | |
| 4,848,542 | A | * | 7/1989 | Burnette et al. | 206/765 |
| 5,087,005 | A | * | 2/1992 | Holoff et al. | 248/205.8 |
| 5,105,946 | A | | 4/1992 | McDowell | |
| 5,174,448 | A | | 12/1992 | Flaig | |
| 5,269,422 | A | * | 12/1993 | Chevrette | 206/448 |
| 5,320,225 | A | * | 6/1994 | Kirkpatrick | 206/449 |
| 5,372,255 | A | | 12/1994 | Skorski | |
| 5,575,389 | A | | 11/1996 | Alspach | |
| 5,605,229 | A | * | 2/1997 | Sowa | 206/454 |
| 5,820,116 | A | * | 10/1998 | Haese | 269/21 |
| 6,267,255 | B1 | | 7/2001 | Brush | |
| 6,527,120 | B2 | * | 3/2003 | Okamoto | 206/454 |
| 2004/0016669 | A1 | * | 1/2004 | Allison | 206/448 |
| 2006/0016709 | A1 | * | 1/2006 | Chen et al. | 206/448 |
| 2008/0150244 | A1 | * | 6/2008 | Carlei | 280/35 |

* cited by examiner

SINGLE GLASS SHEET PACKAGE WITH SUCTION CUPS

CROSS-REFERENCE TO RELATED APPLICATIONS

None.

FEDERALLY SPONSORED RESEARCH OR DEVELOPMENT

N/A.

TECHNICAL FIELD

The invention generally relates to a container for transporting a sheet of glass or similar material, and more particularly to a corrugated container having a plurality of braces, some of which include suction cups, for securely holding and transporting a sheet of glass such as an automotive windshield.

BACKGROUND OF THE INVENTION

Containers for transporting glass sheets must provide sufficient structural support and protection against breakage, while still being lightweight and cost effective. Additionally, such containers must meet specifications set forth by any package carrier service (e.g., Federal Express)

In addition to meeting all of these requirements, such containers should be easy to handle and assemble.

The present invention is provided to solve the problems discussed above and other problems, and to provide advantages and aspects not provided by prior containers of this type. A full discussion of the features and advantages of the present invention is deferred to the following detailed description, which proceeds with reference to the accompanying drawings.

SUMMARY OF THE INVENTION

The present invention provides a container that can securely hold and transport a single glass sheet with encapsulated molding or without. The container is preferably formed from a corrugated material, such as cardboard, and includes suction cups connected or mounted to support structure in the container to securely hold the glass sheet.

According to one embodiment, a container for transporting a glass sheet, such as an automotive windshield is provided. The container includes a generally rectangular first wall portion. However, other shapes can be used. A first support brace is connected to the first wall portion. The first support brace is positioned on the first wall portion to contact and support a first side of a glass sheet. When placing a glass sheet on the first support brace, the first wall portion is typically laid flat on the floor or other surface and can be referred to as the base or bottom of the container. However, during transport the container is typically placed on edge and the first wall portion, in effect, becomes the back or front wall of the container.

A first suction cup is connected to the first support brace. The first suction cup is provided to maintain a secure connection with the glass sheet. The suction cup can be configured to have a cup portion and a base portion having an opening running through it. The brace can include a slot or opening for receiving the base portion of the suction cup. A dowel rod can be inserted through the opening in the base portion of the suction cup (after the suction is positioned on the brace) to lock the suction cup to the brace. All other suctions cups utilized in the container can be secured in a similar manner.

A second wall portion is configured to cooperate with the first wall portion to substantially enclose the glass sheet. The second wall portion is also generally rectangular, but again, can be other suitable shapes. The second wall portion can be considered as the top of the container when loading the glass sheet in the orientation discussed above.

The container also can include a second support brace connected to the first wall portion. The second support brace is also positioned to support the first side of the glass sheet, and is preferably spaced from the first support brace. A second suction cup can be connected to the second support brace. In one configuration, the first suction cup is connected to the first support brace is positioned proximate a first side of the first wall portion, and the second suction cup connected to the second support brace is positioned proximate a second side of the first wall portion.

The first support brace can be a single structure which extends substantially from a first side of the first wall portion to a second side of the first wall portion. Similarly, the second support brace can be a single structure which extends substantially from the first side of the first wall portion to the second side of the first wall portion. The support braces can also be in two or more separate sections.

The container also includes a first side wall extending upward from the first side of the first wall portion, and a second side wall extending upward from the second side of the first wall portion opposing the first side, as well as a first end wall extending upward from a first end of the first wall portion, and a second end wall extending upward from a second end of the first wall portion opposing the first end. Collectively, the outer components of the container form a rectangular box.

The first support brace is formed to include a first cutaway portion proximate the first side of the first wall portion and a second cutaway portion proximate the second side of the first wall portion. Similarly, the second support brace, when utilized, also includes a first cutaway portion proximate the first side of the first wall portion and a second cutaway portion proximate the second side of the first wall portion. The first and second cutaway portions of the support braces are configured to accommodate curvature in the glass sheet. In this manner, the glass sheet is being supported by a portion of the brace contacting the surface of the glass sheet. If the cutaway portions were not present, the curvature of the glass sheet would cause the brace to first contact and support the glass sheet on the edge of the glass sheet on each side.

The container can further include a first opposing side brace for supporting a second side of the glass sheet opposing the first side of the glass sheet. The first opposing side brace can include a third suction cup connected to the brace. Additionally, a second opposing side brace for supporting the second side of the glass sheet having a fourth suction cup can also be utilized. Similar to the support brace(s), the opposing side brace(s) can span from the first side wall to the second side wall of the container. The number of support (and opposing side) braces, and the number and placement of the suction cups, can vary depending on the size of the brace(s) used and the size of the glass sheet being transported.

In addition to the braces extending from the first side of the container to the second side of the container, a first cross support brace can also be connected to the first wall portion. The first cross support brace can extend substantially from the first end of the first wall portion to the second end of the first wall portion. The first cross support brace can include a first glass sheet contacting portion proximate a first end of the first cross support brace. The contacting portion can include a plurality of glass sheet contact segments configured to contact glass sheets of varying sizes. Similarly, the first cross support brace can include a second glass sheet contacting portion proximate a second end of the first cross support brace having a plurality of glass sheet contact segments configured to contact glass sheets of varying sizes. The cross support brace is preferably perpendicular to the first support brace (as well as to the second or other braces when utilized).

In accordance with another embodiment of the invention, a container for transporting a windshield having a slight curvature is provided. The container includes a corrugated base portion having a first side wall integrally formed with and extending upward from a first side of the base portion, and a second side wall integrally formed with and extending upward from a second side of the base portion opposing the first side, a first end wall integrally formed with and extending upward from a first end of the base portion, and a second end wall integrally formed with and extending upward from a second end of the base portion opposing the first end. The container further includes a corrugated first support brace connected to the base portion configured to support a first side of the windshield, and a corrugated second support brace connected to the base portion configured to support the first side of the windshield. A corrugated top portion is configured to cooperate with the base portion to substantially enclose the windshield. The terms "base" and "top" are used in the context of laying the container on the base for positioning and securing the glass sheet in the container as shown in the Figures and is not meant to limit these features to always being in such positions. For example, during transit, the container is positioned so that the glass sheet is positioned on one of its edges and is not laying flat. In this instance, what was referred to as the base when loading the container is now positioned as a side wall.

The container can include a first top brace configured to contact a second side of the windshield and, a second top brace configured to contact the second side of the windshield. The first and second top braces can extend from the first side wall to the second side wall.

A first suction cup can be connected to the first support brace. Similarly a second suction cup can be connected to the second support brace. Additionally, a third suction cup can be connected to the first top brace and, a fourth suction cup can be connected to the second top brace.

The container can include a cross support brace connected to the base portion and extending from proximate the first end of the base portion to a second end of the base portion. Alternatively, the cross support brace can be a first portion for engaging a first side edge of the windshield positioned proximate the first end of the base portion, and a separate second portion for engaging an opposing second edge of the windshield proximate the second end of the base portion.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
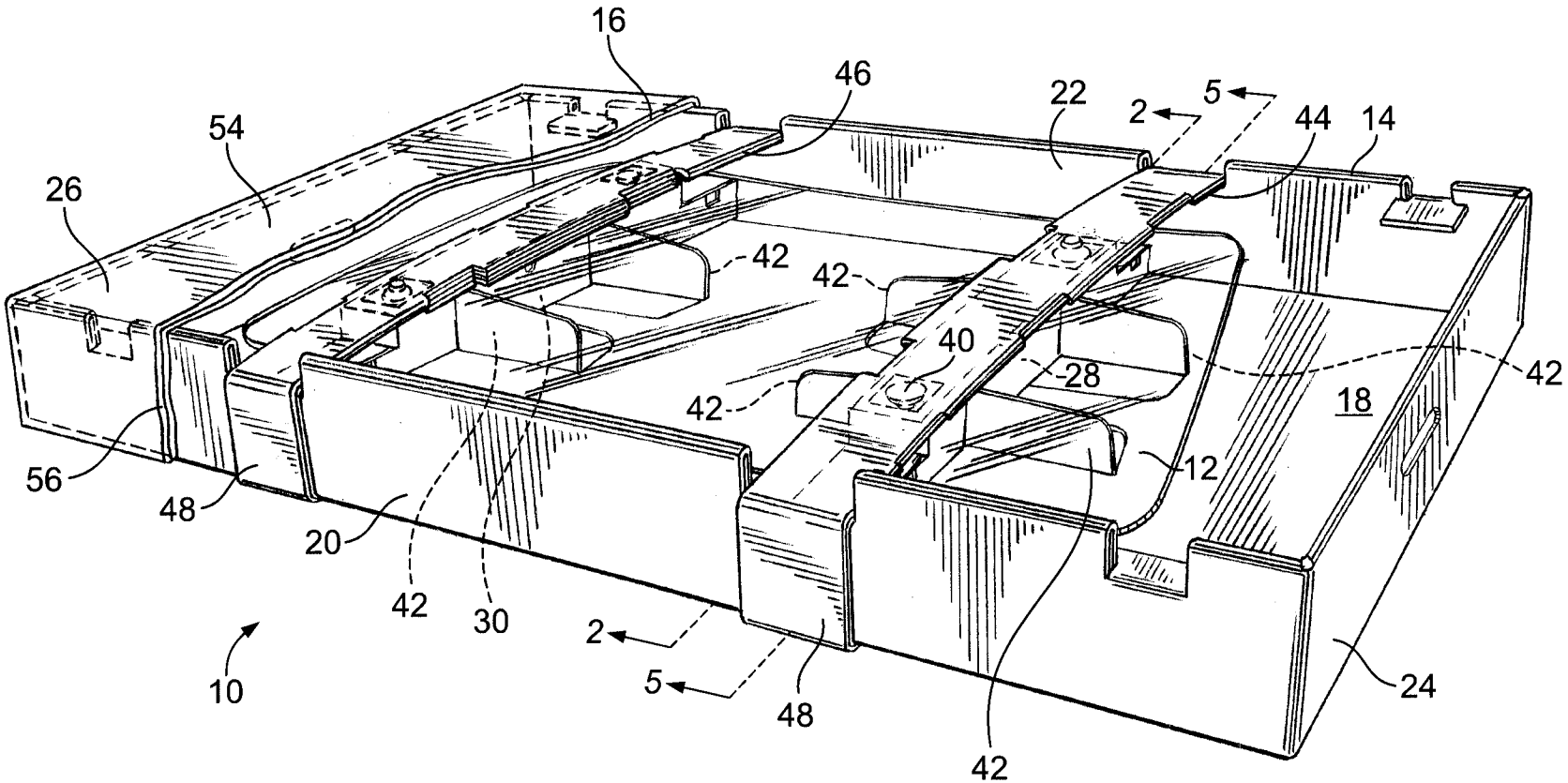
FIG. 1 is a perspective view of an embodiment of a container with the top portion only partial shown in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a container 10 for transporting a single glass sheet 12 is shown. The glass sheet 12 is preferably an automotive windshield having a slight curvature, either with or without full or partial molding.

The container includes a base portion 14 that cooperates with a top portion 16 to form a generally rectangular box. Although reference is made to a base and a top (as the configuration is shown in the Figures), the container may actually be positioned on its side or end during transportation (or possibly upside down). Accordingly, these terms are not intended to limit the container to only being in the position shown.

The base portion 14 includes a generally planar, rectangular base wall 18. A first side wall 20 extends perpendicular to the base wall 18 along a first side of the base wall 18, and a second side wall extends perpendicular to the base wall 18 along a second side of the base wall 18 opposing the first side. A first end wall 24 extends perpendicular to the base wall 18 along a first end of the base wall, and a second end wall 26 extends perpendicular to the base wall along a second end of the base wall 18.

The glass sheet 12 is supported on its lower surface in the base portion 14 by a first support brace 28 and a second support brace 30, which extend from the first side wall 20 to the second side wall 30 (again, the term "lower" is made in reference to the position of the container 10 as shown in the Figures and not as a limitation as to the orientation of the container 10 at all times). In one alternative embodiment, the support braces 28,30 can extend end to end. Moreover, the support braces can be in multiple pieces rather than as a single unit. The number and positioning of the support braces can vary depending on the size of the glass sheet being transported and the amount of support required, and thus can range from one to more than two. Also, cost considerations may dictate or influence the number of support braces.

Figure 2:
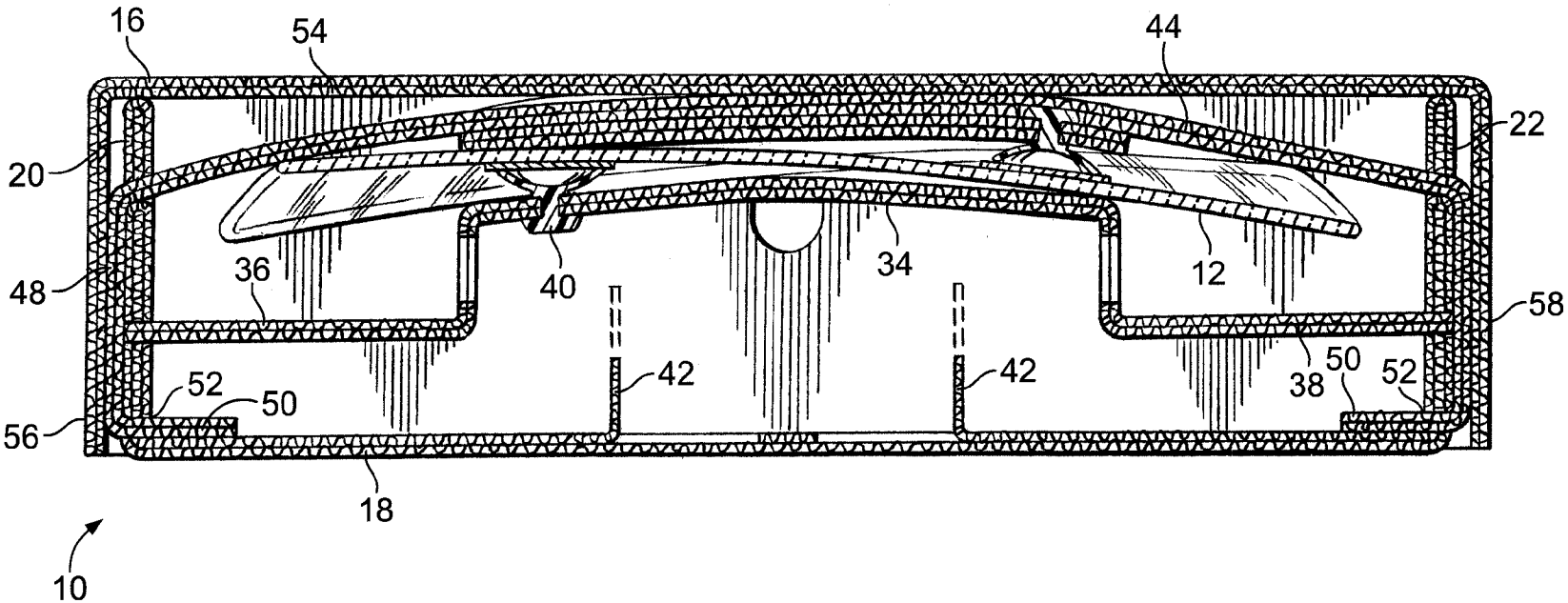
FIG. 2 is a cross-sectional view of the container of FIG. 1 taken along the lines 2-2.

Referring also to FIG. 2, each support brace 28,30 includes a raised central portion 34 between a first lowered or cutaway portion 36 proximate the first side wall 20, and a second lowered or cutaway portion 38 positioned proximate the second side wall 22. The central portion 34 of the brace contacts and supports a central portion of the glass sheet 12. The top surface of the central portion 34 is die cut using a radius score rule which conforms when folded to the bend or curvature of the surface of the glass sheet 12 being contacted.

The lowered or cutaway portions 36,38 provide space to accommodate the curvature of the glass sheet 12 at the sides. In this manner, the braces 28,30 are able to come into contact with the surface of the glass sheet 12 rather than supporting the glass sheet 12 on its edges.

A suction cup 40 is connected to the central portion of the brace in order to more securely hold the glass sheet 12 in place. In the embodiment shown in FIG. 1, a suction cup 40 is connected to the central portion 34 proximate the first lowered portion 36 on the first brace 28, while another suction cup is connected to the central portion 34 proximate the second lowered portion 38 on the second support brace 30. However, additional suction cups can be connected at various positions on the braces 28,30 (see e.g., FIG. 4).

The support braces 28,30 are securely kept in position by flaps 42 folded from the base wall 18. Two flaps 42 are shown on each side of the braces 28,30. The flaps 42 can cooperate with grooves or slots formed in the support braces 28,30 to maintain the flaps in the upright positions shown in the Figures.

The container also includes a first top brace 44 and a second top brace 46. The top braces 44,46 are aligned with the first support brace 28 and the second support brace 30, respectively. The top braces 44,46 lay over and contact the opposing or top side of the glass sheet 12. Similar to the support braces 28,30, suction cups 40 can be connected to the top braces 44,46 to more securely grip and hold the glass sheet 12 in place. As shown in FIGS. 1 and 2, each top brace includes a single suction cup 40, however, more than one suction cup 40 can be used.

Also similar to the support braces 28,30, the top braces 44,46 can include a contacting surface that is curved to conform to the shape of the surface of the glass sheet 12 contacted. Alternatively, the top braces 44,46 can be formed to be flexible and be sized so that the brace bends in accordance with the curvature of the upper surface of the glass sheet 12.

As with the support braces contacting the lower side of the glass sheet 12, the number of top braces and their dimensions can vary depending on the characteristics of the glass sheet, the requirements of the carrier, costs, etc. In this regard, in one embodiment only a single top brace is used, preferably over the middle of the glass sheet 12, while in other embodiments three or more braces may be utilized.

The top braces 44,46 include fold down flaps 48 at both ends of the brace. The fold down flaps 48 extend over the side walls 20,22 and include a further fold 50 that can be inserted in a slot 52 in the side wall. In this manner the top braces 44,46 can be securely attached to the base portion 14.

The top 16 is configured to include a top wall 54, side walls 56,58 and end walls. The top 16 is sized to be placed over the base portion 14 to form a box. Straps or other means can be used to ensure the top 16 does not separate from the base portion 14 during transportation of the container 10.

Figure 3:
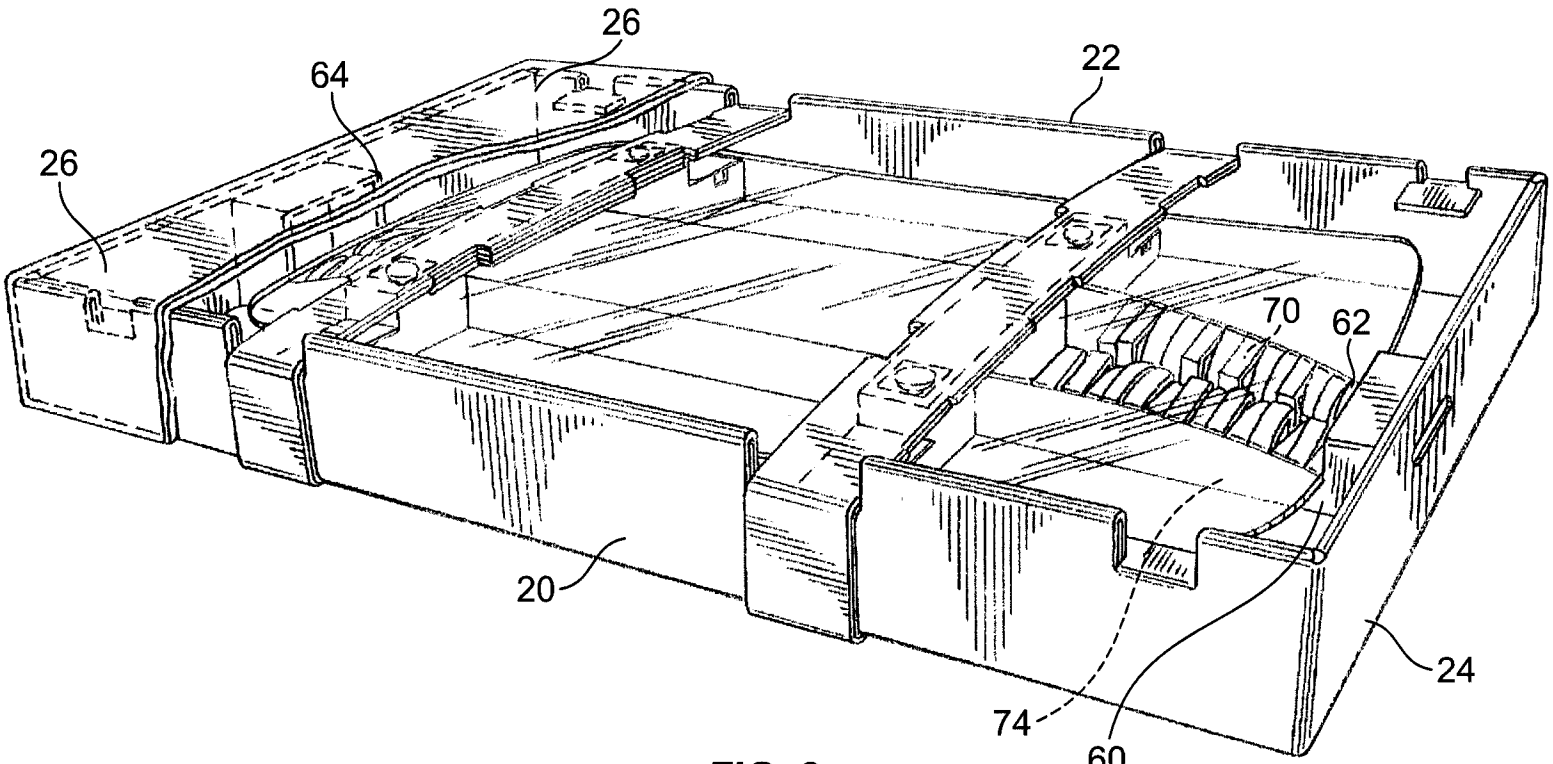
FIG. 3 is a perspective view another embodiment of a container in accordance with the present invention.
Figure 4:
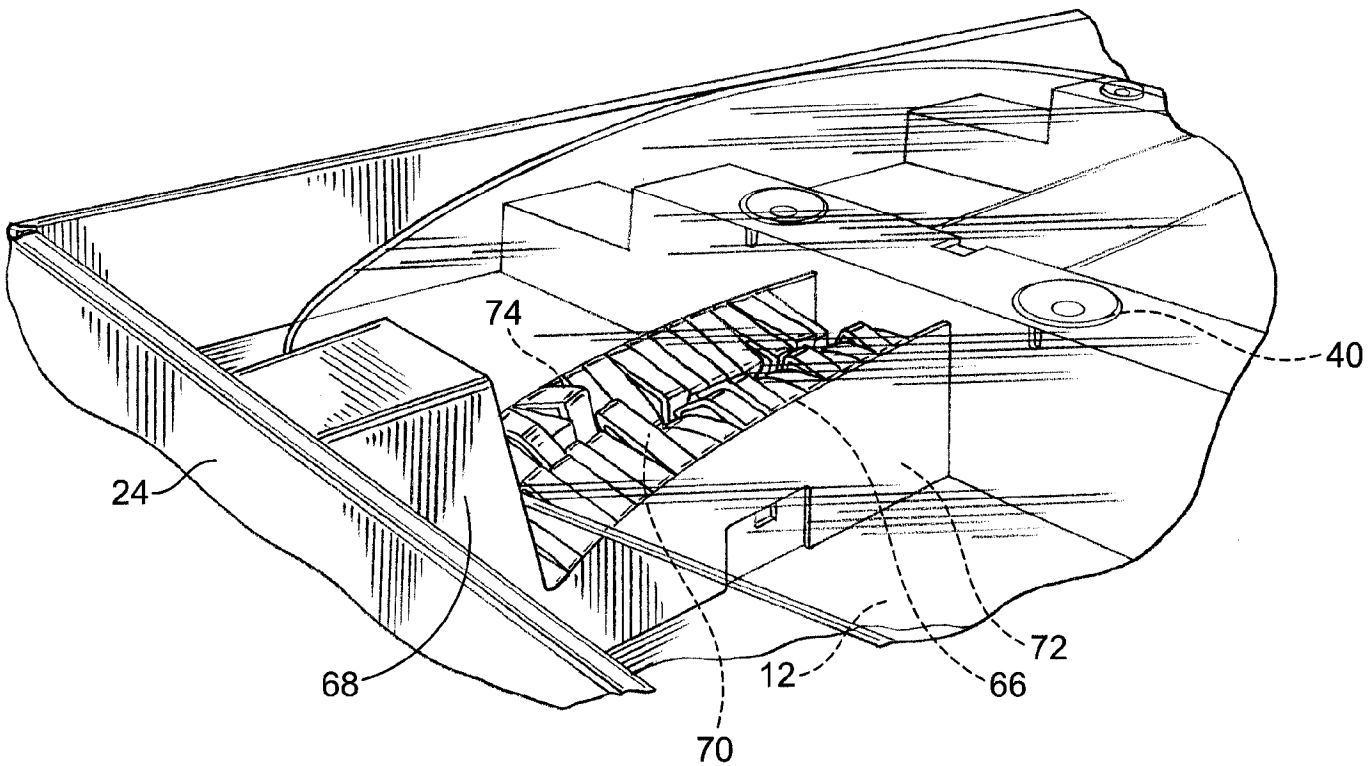
FIG. 4 is a partial perspective view of a portion of the container of FIG. 3.

Referring to FIGS. 3 and 4, an alternative embodiment of the container 10 is shown. In this embodiment, an additional cross support brace 60 is provided on the base portion 14 of the container 10. The cross support brace 60 is positioned perpendicular to the first and second support braces 28,30 and extends from the first end wall 24 to the second end wall 26.

The cross support brace 60 includes a first end portion 62 and an opposing second end portion 64. The end portions 62,64 are configured to engage and support the ends of the glass sheet 12. Each end portion 62,64 includes an upper surface that is slanted at an angle and/or curved with respect to the generally planar base wall 18 to form an angled or curved portion 66. The angled or curved portion 66 extends from one of the first or second support braces 28,30 to a block portion 68 proximate the end wall 24,26. The angled or curved portion 66 becomes increasing lower (i.e., closer to the base wall 18) as it approaches the block portion 68. The angled or curved portion 66 is also provided to accommodate curvature in the glass sheet 12 which is commonly found in automotive windshields.

The angled or curved portion 66 includes a plurality of parallel cuts or slots in the material. The slots form a plurality of adjacent segments 70 spanning across the top of the end portion. The sides 72,74 of the end portion 62,64 are position closer than the length of the segments 70. This causes the segments 70 to generally buckle into the interior of the end portion 62,64. However, depending on the size of the glass sheet 12 (i.e., from end to end) a select segment 70 can be positioned to buckle upward from the end portion 62,64. In this manner, the end portions 62,64 can be used to contact and support glass sheets 12 of varying sizes. The end portions 62,64 are designed to engage an edge of the glass sheet 12.

Similar to the other braces discussed, the cross support brace 60 can be one piece, or a plurality of pieces or segments between the first and second ends of the container 10. Moreover, more than one cross support brace can be utilized depending on the size of the glass sheet, support required or other factors.

Figure 5:
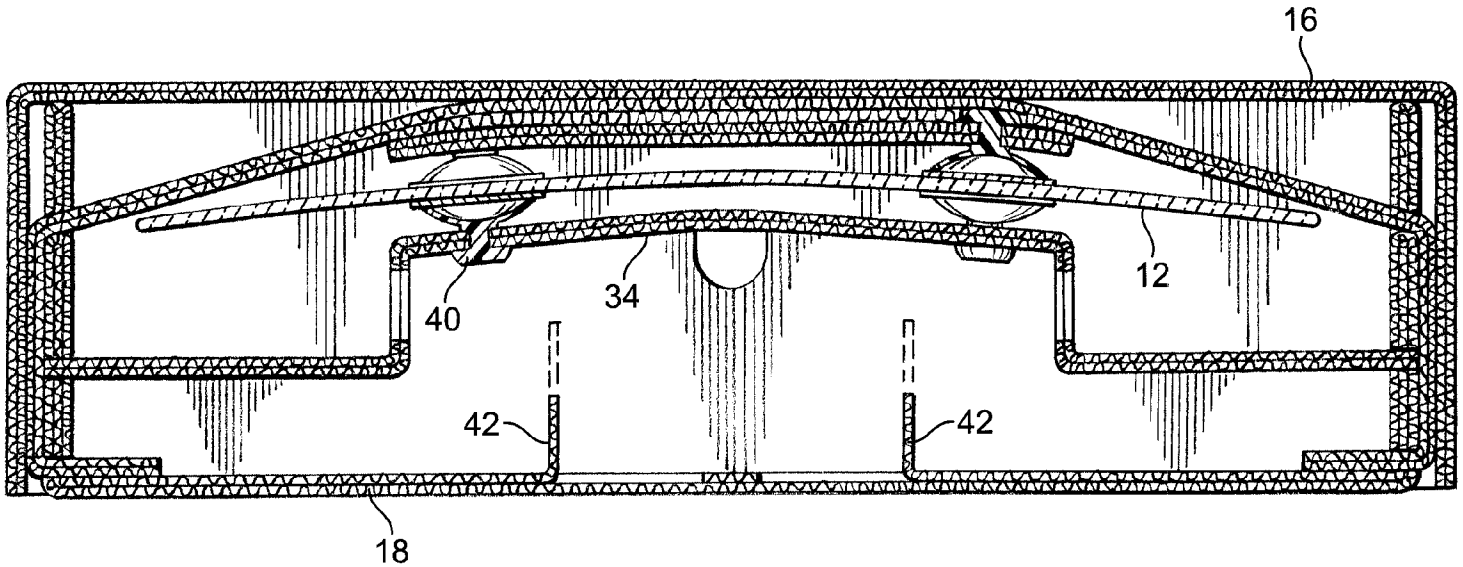
FIG. 5 is a cross-sectional view of the container of FIG. 1 taken along the lines 5-5.

Referring back to FIG. 2, the glass sheet is contacted on one side of the central portion 34 by the suction cup 40, but is supported by the top surface of the central portion 34 on the side. However, as shown in the cross-section of FIG. 5, if the glass sheet is light enough, or during transit when the container 10 is positioned on one of its sides or ends, the glass sheet 12 is held between the support and top braces by the suction cups 40 and does not necessarily abut any of the braces.

The first and second support braces 28,30 and the top braces 44,46, along with the suction cups 40, act like shock absorbers for the glass sheet 12 in the container 10. This helps protect the glass sheet 12 from impacts or other jarring movement of the container 10 during transportation from one location to the next.

In order to avoid any prints or scratches on the surfaces of the glass sheet 12 from the suction cups 40, a sheet of material can be inserted between the cup 40 and the respective surface of the glass sheet.

Figure 6B:
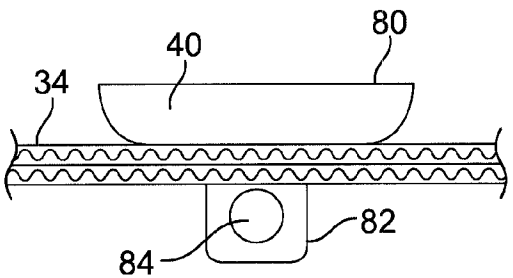
FIG. 6B is a cross-sectional view of the suction cup of FIG. 5A positioned in a brace in the container.
Figure 6A:
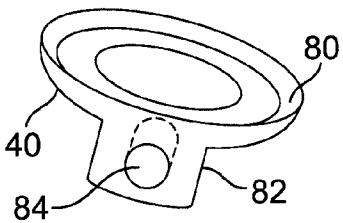
FIG. 6A is a perspective view of a suction cup for use with the container of the present invention.

Referring to FIGS. 6A and 6B, the suction cups 40 utilized in the container 10 preferably comprise a cup portion 80 and a base portion 82. The base portion 82 includes an opening 84. The base portion 82 of the suction cup 40 is inserted through a slot or opening in the brace.

Figure 7:
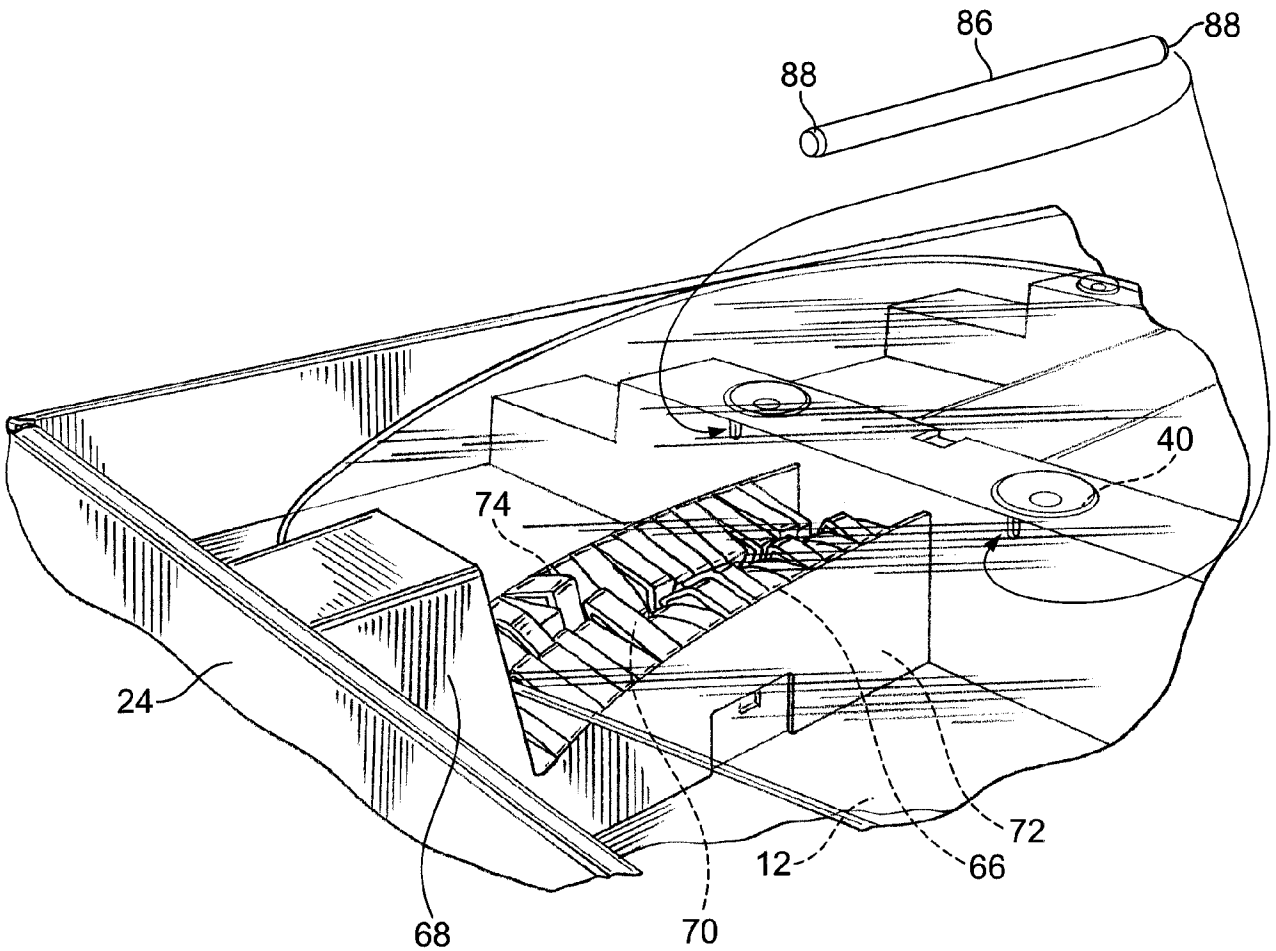
FIG. 7 is the partial perspective view of FIG. 4 showing positioning of dowel rods for holding the suction cups in place.

As illustrated in FIG. 7, a dowel rod 86 is inserted into the opening 84 of the suction cup 40 to lock the suction cup in place on the brace. The dowel rod 86 has a ⅜ inch diameter and is 4½ inches long with tapered ends 88. The dowel rod is long enough to fit through the base portion 82 and have enough exposed on either side to grab for removal. A dowel rod 86 is used for each suction cup 40 in both the support braces 28,30 connected to the base wall 18, and the top braces 44,46. Wood and other suitable material can be utilized to form the rods 86.

Other than the suction cups 40 and dowel rods 86, the various components of the container 10 (in all embodiments shown) are formed out of a corrugated material, such as cardboard. The corrugated material can be a plurality of foldable blanks. In this manner, the corrugated material can be shipped in a flattened, collapsed state, and the container can be set-up on site by folding the components into the required structures. Additionally, the number of folded layers in a component can be increased or decreased to provide structures of varying strength to accommodate varying sized glass sheets or meet carrier or other criteria.

While the specific embodiments have been illustrated and described, numerous modifications come to mind without significantly departing from the spirit of the invention, and the scope of protection is only limited by the scope of the accompanying Claims.

What is claimed is:

1. A container for transporting a glass sheet comprising:

a base portion including a first wall portion, a first side wall extending from the wall portion along a first side of the base portion and a second side wall extending from the wall portion along a second side of the base portion;

a first support brace connected to the first wall portion, the first support brace positioned to support a first side of a glass sheet;

a first suction cup connected to the first support brace positioned to contact the first side of the glass sheet;

a first top brace aligned with the first support brace and extending from the first side wall to the second side wall across a second side of the glass sheet, the first top brace connected to the first side of the base portion by a first flap extending over the first side wall from a first end of the first top brace and connected to the second side of the base portion by a second flap extending over the second side wall from a second end of the first top brace; and, a second wall portion configured to cooperate with the first wall portion, first side wall and second side wall to substantially enclose the glass sheet.

2. The container of claim 1 further comprising:

a second support brace connected to the first wall portion, the second support brace positioned to support the first side of the glass sheet; and, a second suction cup connected to the second support brace positioned to contact the first side of the glass sheet.

3. The container of claim 2 wherein the first support brace extends substantially from the first side of the first wall portion of the base portion to the second side of the wall portion, and the second support brace extends substantially from the first side of the wall portion to the second side of the wall portion.

4. The container of claim 3 further comprising:

a first end wall extending upward from a first end of the wall portion of the base portion, and a second end wall extending upward from a second end of the wall portion opposing the first end.

5. The container of claim 3 wherein the first support brace includes a first cutaway portion proximate the first side of the first wall portion of the base portion and a second cutaway portion proximate the second side of the wall portion, and the second support brace includes a first cutaway portion proximate the first side of the wall portion and a second cutaway portion proximate the second side of the wall portion wherein the first and second cutaway portions of the first support brace and the first and second cutaway portions of the second support brace are configured to accommodate curvature in the glass sheet.

6. The container of claim 4 further comprising:

a third suction cup connected to the first top brace positioned to contact a second side of the glass sheet.

7. The container of claim 6 further comprising:

a second top brace for supporting the second side of the glass sheet, the second top brace extending from the first side wall to the second side wall across the glass sheet; and, a fourth suction cup connected to the second top brace positioned to contact the second side of the glass sheet.

8. The container of claim 7 wherein the first top brace and the second top brace are formed from a corrugated material.

9. The container of claim 4 further comprising:

a first cross support brace connected to the first wall portion, the first cross support brace extending substantially from the first end of the wall portion to the second end of the wall portion.

10. The container of claim 9 wherein the first cross support brace includes a first glass sheet contacting portion proximate a first end of the first cross support brace having a plurality of glass sheet contact segments configured to contact glass sheets of varying sizes.

11. The container of claim 10 wherein the first cross support brace includes a second glass sheet contacting portion proximate a second end of the first cross support brace having a plurality of glass sheet contact segments configured to contact glass sheets of varying sizes.

12. The container of claim 1 wherein the wall portion of the base portion, first support brace, and second wall portion are formed from a corrugated material.

13. The container of claim 2 wherein the first suction cup connected to the first support brace is positioned proximate a first side of the wall portion, and the second suction cup connected to the second support brace is positioned proximate a second side of the wall portion.

14. A container for transporting a windshield comprising:

a corrugated base portion, a first side wall integrally formed with and extending upward from a first side of the base portion, and a second side wall integrally formed with and extending upward from a second side of the base portion opposing the first side;

a first end wall integrally formed with and extending upward from a first end of the base portion, and a second end wall integrally formed with and extending upward from a second end of the base portion opposing the first end;

a corrugated material first support brace connected to the base portion by a flap extending from the base portion, the first support brace configured to support a first side of the windshield and a corrugated material first top brace aligned with the first support brace connected to the base portion, the first top brace configured to span from the first side wall to the second side wall across a width of the windshield and contact at least a portion of a second side of the windshield to support the second side of the windshield, the first top brace including a first flap extending over the first side wall and a second flap extending over the second side wall; and, a corrugated top portion configured to cooperate with the base portion to substantially enclose the windshield.

15. The container of claim 14 further comprising:

a corrugated material second support brace connected to the base portion configured to support the first side of the windshield and, a corrugated material second top brace configured to span across a width of and contact at least a portion of the second side of the windshield to support the second side of the windshield.

16. The container of claim 15 wherein the second top brace extends from the first side wall to the second side wall.

17. The container of claim 16 further comprising:

a first suction cup connected to the first support brace; and, a second suction cup connected to the second support brace.

18. The container of claim 17 further comprising:

a third suction cup connected to the first top brace; and, a fourth suction cup connected to the second top brace.

19. The container of claim 14 further comprising:

a cross support brace connected to the base portion extending from proximate the first end of the base portion to a second end of the base portion.

20. The container of claim 19 further comprising:

a first glass sheet contacting portion proximate a first end of the cross support brace having a plurality of glass sheet contact segments, and a second glass sheet contacting portion proximate a second end of the cross support brace having a plurality of glass sheet contact segments, wherein the first glass sheet contacting portion and the second glass sheet contacting portion are configured to contact glass sheets of varying sizes.

* * * * *